US007917283B2

(12) United States Patent
Kado

(10) Patent No.: US 7,917,283 B2
(45) Date of Patent: Mar. 29, 2011

(54) ENGINE CONTROL UNIT SYSTEMS AND METHODS FOR A BOAT PROPULSION SYSTEM

(75) Inventor: Takuya Kado, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 404 days.

(21) Appl. No.: 12/061,957

(22) Filed: Apr. 3, 2008

(65) Prior Publication Data

US 2008/0280511 A1 Nov. 13, 2008

(30) Foreign Application Priority Data

May 7, 2007 (JP) ..... 2007-122652

(51) Int. Cl.
*B60W 10/04* (2006.01)

(52) U.S. Cl. ..... 701/110; 701/103; 701/104; 477/107; 477/109; 477/110; 477/111; 470/87

(58) Field of Classification Search ..... 440/1, 84, 440/86, 87, 113; 701/102, 103, 104, 105, 701/101, 110; 123/406.24, 406.25, 406.3, 123/406.32, 406.35, 406.36, 406.45, 406.46, 123/406.47, 406.5, 406.51, 406.52; 477/107, 477/109, 110, 111, 112, 113

See application file for complete search history.

(56) References Cited

U.S. PATENT DOCUMENTS

| | | | | |
|---|---|---|---|---|
| 6,015,319 | A * | 1/2000 | Tanaka | 440/84 |
| 6,612,882 | B2 * | 9/2003 | Shidara et al. | 440/1 |
| 6,942,530 | B1 * | 9/2005 | Hall et al. | 440/1 |
| 7,680,582 | B2 * | 3/2010 | Ishida et al. | 701/103 |

FOREIGN PATENT DOCUMENTS

| | | | |
|---|---|---|---|
| JP | 06-117315 | * | 4/1994 |
| JP | 09-004488 | | 1/1997 |

* cited by examiner

*Primary Examiner* — Stephen K Cronin
*Assistant Examiner* — Raza Najmuddin
(74) *Attorney, Agent, or Firm* — Keating & Bennett, LLP

(57) ABSTRACT

A predicted boat speed value generator, in accordance with one or more embodiments, receives an engine rotation signal, an intake pressure value, and other detection signals including shift position, and provides a predicted boat speed value. A control signal generator determines the fuel injection amount, the amount of air, and the ignition timing based on the predicted boat speed to provide respective control signals. The predicted boat speed value generator includes a predicted boat speed mapped value extraction process to search through the predicted boat speed value map during the constant speed operation and acceleration, based on the rotational speed and the intake pressure, to extract the predicted boat speed mapped value "d" for output. A predicted decelerating boat speed value output process establishes the initial predicted boat speed value to provide the attenuated predicted boat speed value in every cycle.

17 Claims, 6 Drawing Sheets

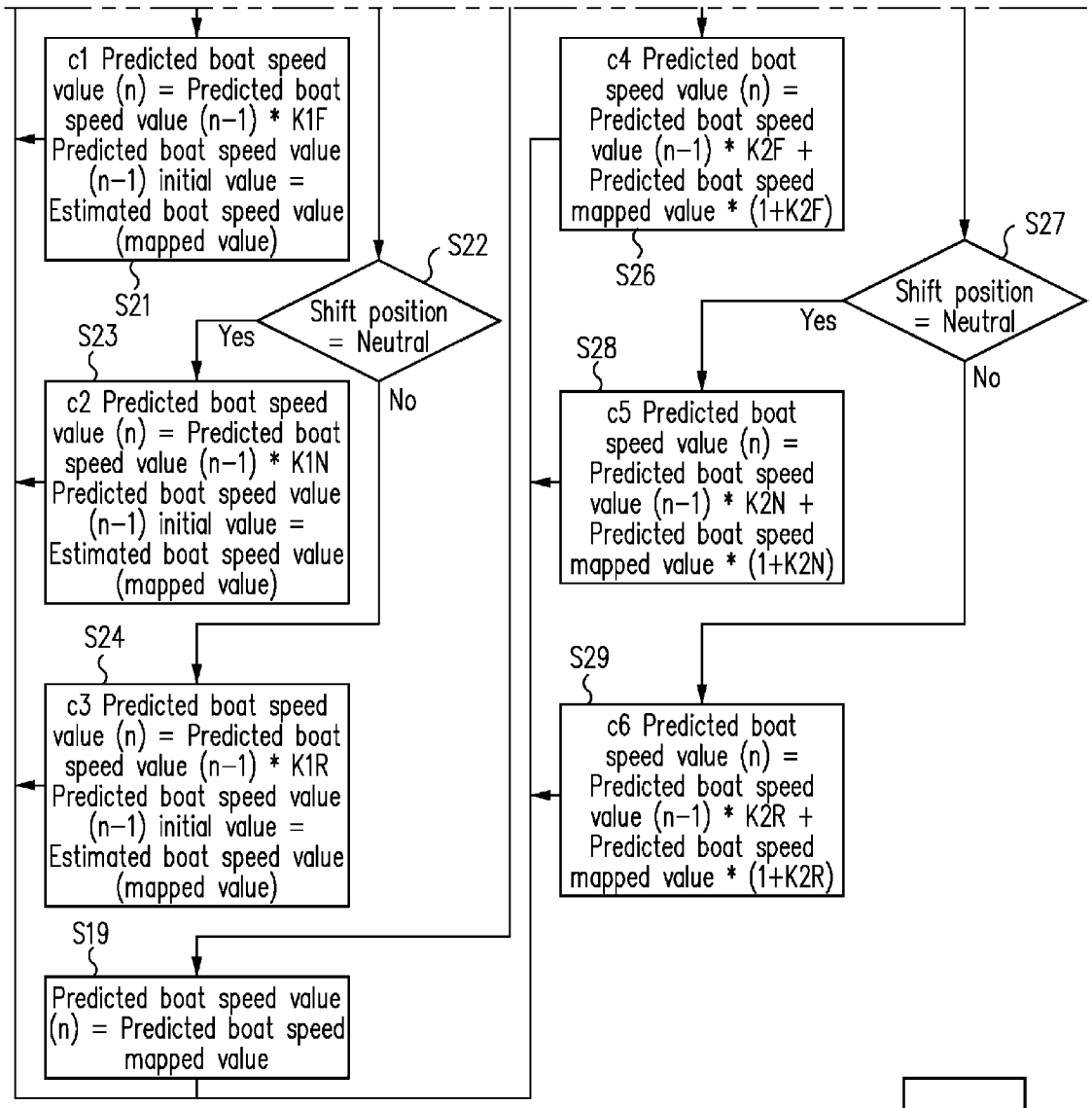
FIG. 3B
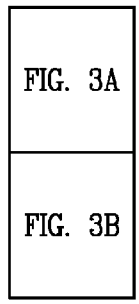
KEY TO FIG. 3

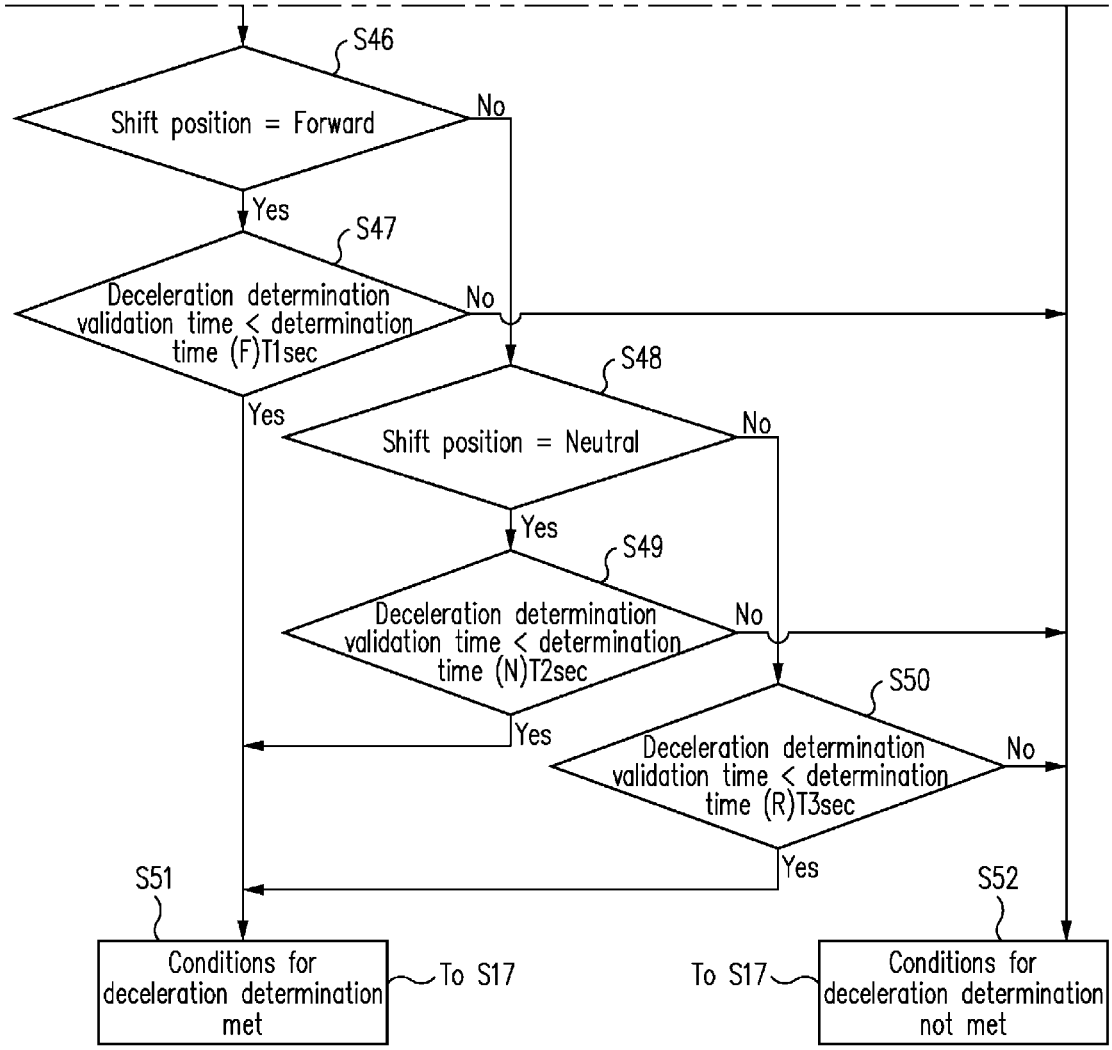
FIG. 4B
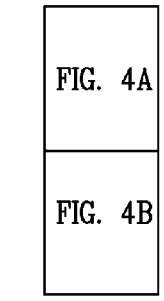
KEY TO FIG. 4

ENGINE CONTROL UNIT SYSTEMS AND METHODS FOR A BOAT PROPULSION SYSTEM

CROSS-REFERENCE TO RELATED APPLICATIONS

This application is related to and claims priority to Japanese Patent Application No. 2007-122652, filed on May 7, 2007, the entire contents of which is incorporated herein by reference in its entirety.

TECHNICAL FIELD

The present invention relates generally to an engine control unit for a boat propulsion system, which controls a fuel injection amount, an amount of air, and an ignition timing of an engine in the boat propulsion system, and a boat incorporating the engine control unit and boat propulsion system.

BACKGROUND

A propulsion system provided on a boat typically has an engine for obtaining a propulsion force by rotating a propeller using the power of the engine. Some boat propulsion systems have an engine control unit by which the fuel injection amount, the amount of air, or the ignition timing are controlled based on the engine speed, the intake pressure in the downstream side of the throttle valve, or the throttle position.

For example, according to the operating status control device for the internal combustion engine disclosed in Japanese Patent Document JP-A-Hei 06-117315, the control values for an engine operating status are determined based on the predicted value of the intake pressure. Specifically for this example, an intake pressure is detected by sampling, and a predicted value is obtained by multiplying the difference between the present detected value and the previously detected value by a prediction coefficient, with the present value then added to the value obtained by the multiplication. In such a computation of the predicted value, different prediction coefficients are applied to the acceleration state and to the deceleration state of the engine for determining a predicted intake pressure, based on which of the control values is determined for the applicable engine operating status.

As another example according to an abrupt acceleration and an abrupt deceleration control method and device for the internal combustion engine disclosed in Japanese Patent Document JP-A-Hei 09-004488, the fuel injection amount and the ignition timing are controlled in a manner such that the control method can catch up with the change in speed during an abrupt acceleration or deceleration to improve the acceleration performance and to prevent engine stall during the deceleration. Such a control method uses a correction table (map) containing the spark advance or spark retard angle and the additional fuel injection amount applicable to the abrupt acceleration, along with a correction table (map) containing the additional fuel injection amount applicable to the abrupt deceleration for controlling the engine with the increased fuel injection amount after the correction and the ignition timing after the adjustment.

As a further example according to other conventional engine control units for a boat propulsion system, a predicted boat speed value map based on the engine speed and the intake pressure is prepared, the engine speed and the intake pressure are detected, and a mapped value is extracted from the predicted boat speed value map in relation to the detected values, and the amount of air and the fuel injection amount are determined according to the mapped value. Specifically for this example, the boat speed was detected as a value determined by the mapped value extracted from the predicted boat speed value map based on the engine speed and the load. The predicted boat speed during the deceleration is determined by the computation utilizing the mapped value as an initial base value, because the amount of air and the fuel injection amount must be increased to prevent the engine stall in the course of deceleration.

In prior conventional approaches, not the mapped value but rather the tailing (a process of gradually dropping the boat speed first, and then recovering the speed gradually) was utilized for detecting the engine speed and the intake pressure. Also, the shift-in and shift-out operations involving the different loads were distinguished by detecting the neutral switch on and off operation, and after extracting the attenuation coefficient (attenuation time and attenuation amount) from the map, which is set to be different between the shift-in and shift-out operations, the predicted boat speed value was determined by applying the detected values of the rotational speed and the intake pressure, the attenuation coefficient, and the cycle. Then, the applicable amount of air and the fuel injection amount were determined according to the predicted boat speed value.

The boat speed during the deceleration was estimated by the predicted value obtained by attenuating the speed to the end of a time limit that was set to be different between the shift-in and shift-out operations. In addition, when the boat speed transitions from the deceleration to the non-deceleration state (namely, the constant speed or the acceleration), the speed was recovered by given increments toward the boat speed determined by the rotational speed and the intake pressure. Therefore, if the acceleration took place between the deceleration and the recovery from the deceleration, the predicted speed value may deviate from the actual boat speed, resulting in poor acceleration in the course of speed recovery from the deceleration.

SUMMARY

According to one or more of the conventional engine control units of the boat propulsion systems described above, although the different attenuation coefficients and the attenuation times were applied to the shift-in and shift-out operations during the deceleration, the forward and reverse shift positions were not distinguished from each other in the shift-in operation, despite the difference in the operating loads between the forward and reverse shift positions, with identical attenuation coefficients and time limits applied. Therefore, engine stall and rotational speed fluctuations could occur.

Furthermore, because the attenuation continued to the end of the attenuation time during the deceleration, the predicted boat speed was substantially different from the actual boat speed in the case of an operating pattern where the deceleration is followed by a brief, transient acceleration and immediate deceleration when pulling up the boat alongside the quay. Thus, the fuel injection amount and the amount of fuel could not be optimized, resulting in possible engine stall or speed fluctuation.

In contrast in accordance with one or more embodiments, an engine control unit of a boat propulsion system is disclosed in which the attenuation rate of the engine speed after the deceleration may be improved to obtain the predicted boat speed generally equal to the actual boat speed, and the appropriate control on the amount of injected fuel and the amount of air may be achieved to deal with the various engine operating patterns. Furthermore, a boat is disclosed, which incorporates the systems and methods of the engine control unit of the boat propulsion system as disclosed herein in accordance with one or more embodiments.

More specifically in accordance with an embodiment, a first aspect to the present invention is directed to an engine control unit for a boat propulsion system having a predicted boat speed value generator for providing (outputting) predicted boat speed values by receiving (inputting) a detected signal related to an engine speed, an intake pressure value taken from a downstream side of the throttle valve, and each detection signal of a lever position, a shift position, and a throttle position, and by performing a required processing. The first aspect further includes a control signal generator for receiving (inputting) the predicted boat speed from the predicted boat speed value generator and determining an injection amount, an amount of air, and an ignition timing based on the predicted boat speed to provide (output) the respective control signals, in which the predicted boat speed value generator has a predicted boat speed mapped value extracting means for performing the search through the predicted boat speed value map during a constant speed operation and an acceleration, based on the rotational speed and the intake pressure, and extracting the predicted boat speed mapped value for output. The first aspect further includes a predicted decelerating boat speed value output means for initially inputting the last predicted boat speed mapped value at the time of deceleration, establishing the initial predicted boat speed value by multiplying the attenuation coefficients that varies according to the shift positions by the predicted boat speed mapped value obtained at the end of the deceleration, performing the similar computation in each of the following cycles using last predicted boat speed mapped value, and outputting the attenuating predicted boat speed value in every cycle.

In accordance with an embodiment, a second aspect of the invention is in addition to the configuration described in the first aspect, in which the predicted decelerating boat speed value output means is capable of setting different attenuation validation times for each shift position of the forward, neutral and reverse.

In accordance with an embodiment, a third aspect of the invention is in addition to the configuration described in the first or second aspect, further including a predicted recovering boat speed value output means for performing the search through the predicted boat speed value map when the boat speed transitions from the deceleration to the constant speed or to the acceleration, based on the rotational speed at the beginning of the speed transition and the intake pressure, extracting the predicted boat speed mapped value, and at the same time, inputting the predicted boat speed value obtained at the end of deceleration, to establish the initial predicted boat speed value by multiplying the incremental coefficient that varies according to the shift positions by the predicted boat speed mapped value obtained at the end of deceleration. The third aspect further includes performing the similar computation in each of the following cycles by applying the last predicted boat speed mapped value and the predicted boat speed mapped value, and outputting the gradually increasing predicted boat speed value in every cycle.

In accordance with an embodiment, a fourth aspect of the invention is in addition to the configuration described in any one of the first through third aspects of the invention, in which a process is configured to determine if the boat speed has made transition to the deceleration state, or has made a transition to the boat speed recovery state into the constant speed or the acceleration, and, by way of the control according to the predicted recovering boat speed value output means according to the third aspect, to recover the control based on the predicted boat speed mapped value extracting means according to the first or second aspect.

In accordance with one or more embodiments, a fifth aspect of the invention is a boat provided with the engine control unit for the boat propulsion system according to any one of the first through fourth aspects.

In accordance with an embodiment and based on the aspects disclosed herein, a method for controlling a boat propulsion system includes receiving signals related to an engine speed, an intake pressure, a lever position, a shift position, and a throttle position; processing the signals to provide predicted boat speed values; determining an injection amount, an amount of air, and an ignition timing based on the predicted boat speed values; providing a fuel injection control signal, an air adjustment control signal, and an ignition timing control signal based on the determining; searching through a predicted boat speed value map during a constant speed operation and an acceleration, based on the signals related to the engine speed and the intake pressure; providing a predicted boat speed mapped value based on the searching; and determining an initial predicted boat speed value by multiplying attenuation coefficients that vary according to the shift positions by the predicted boat speed mapped value obtained at an end of a deceleration.

In accordance with one or more embodiments described in each aspect, the attenuation rate of the engine speed after the deceleration may be improved to obtain the predicted boat speed generally equal to the actual boat speed, and the appropriate control on the amount of injected fuel and the amount of air may be achieved to deal with the various engine operating patterns. More specifically for example, the attenuation rate of the predicted boat speed values is appropriately different among the forward, neutral, and reverse shift positions during the deceleration, and is updated in every cycle. Thus the predicted boat speed obtained by computation may be kept close to the actual boat speed regardless of the shift position in the forward, neutral, or reverse, resulting in the appropriate decrease in the fuel injection amount and the amount of air. Even when the shift lever is operated in such a pattern that the deceleration is followed by a brief, transient acceleration (that is, an acceleration for a minimal period of time) and by the immediate deceleration within a limited time frame such as to pull up the boat alongside the quay, the predicted boat speed generally equal to the actual boat speed may be obtained, allowing the generation of driving torque compatible with the boat speed and smooth maneuvering. Thus, the swift maneuvering for pulling up the boat alongside the quay may be achieved.

According to the second aspect in accordance with an embodiment of the invention, the predicted boat speed obtained by computation may be kept close to the actual boat speed regardless of the shift position in the forward, neutral, or reverse. Also, the predicted boat speed value decreases in every cycle to allow the appropriate decrease regarding the fuel injection amount and the amount of air. This allows the smooth transition of the engine speed, and the engine hunting and engine stall may be avoided.

According to the third aspect in accordance with an embodiment of the invention, the increment rate of the predicted boat speed values is appropriately different among the forward, neutral, and reverse shift, and is updated in every cycle. Thus the predicted boat speed obtained by computation may be kept close to the actual boat speed to achieve the appropriate increase in the fuel injection amount and the amount of air. Thus, a smooth transition of the boat speed from deceleration to a constant speed or to acceleration may be achieved, while avoiding the occurrence of engine hunting or engine stall.

According to the fourth aspect in accordance with an embodiment of the invention, the recovery to a constant speed or to acceleration that employs the predicted boat speed mapped value may be achieved by way of the computation of predicted boat speed at the recovery. Thus, the predicted boat speed value may be kept close to the actual boat speed, which allows the appropriate control on the amount of injected fuel and the amount of air in response to the various engine operating patterns, which may allow smooth maneuvering. Accordingly, the predicted boat speed value may be maintained at an equal level to the actual boat speed value in various operating patterns of outboard motors, which may allow the appropriate control on the amount of injected fuel and the amount of air, smooth deceleration in any operating environment, and stabilized engine speed after the deceleration.

According to the fifth aspect in accordance with an embodiment of the invention, the effects of the embodiments may be identical with those obtained for the embodiments described in any one of the first through fourth aspects and may be achieved for a boat.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

FIGS. 3A and 3B are flow charts (main routine) showing the control procedure performed by the predicted boat speed value generator of the engine control unit shown in FIG. 1 according to an embodiment.

FIGS. 4A and 4B are flow charts (sub routine) showing the detailed control procedure related to Step S17 in FIG. 3 according to an embodiment.

Figure 1:
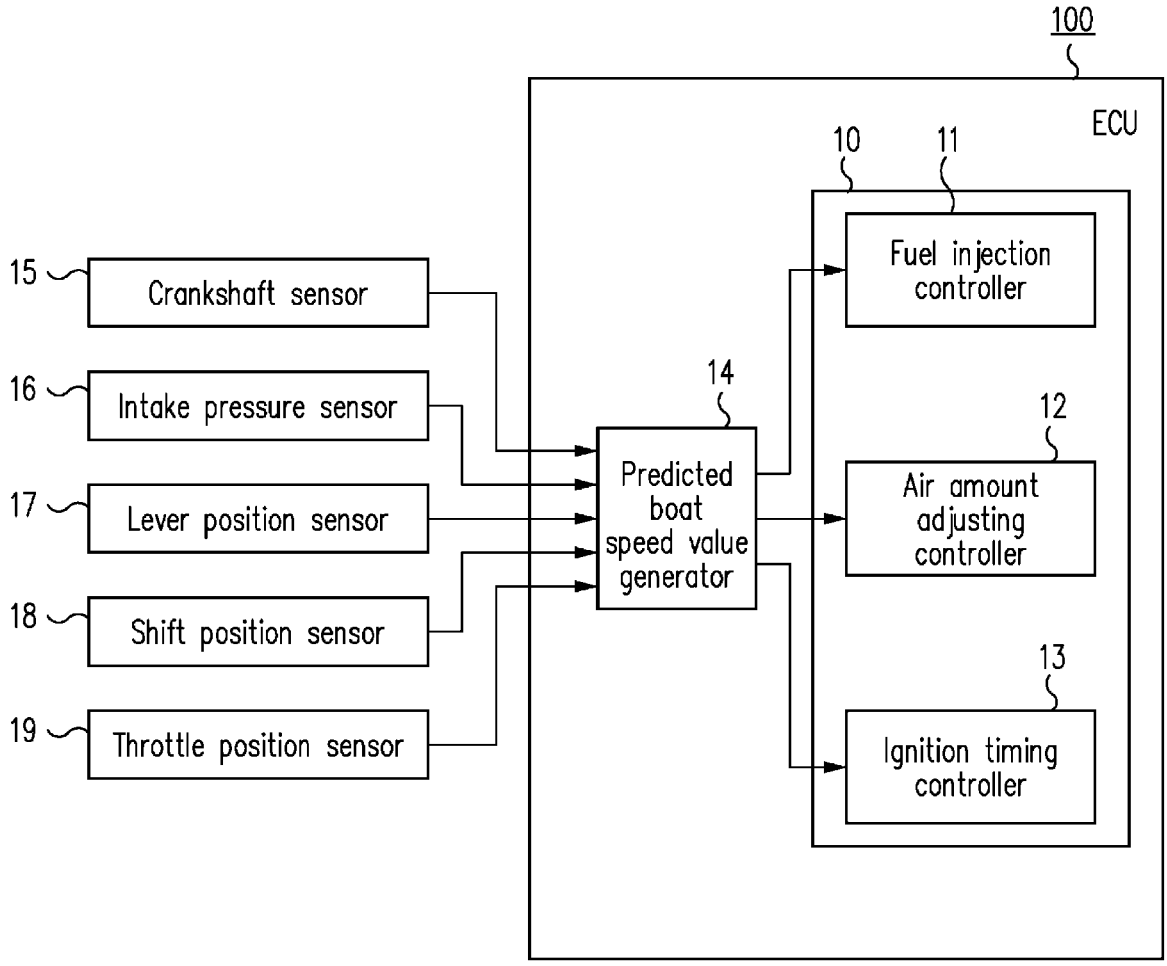
FIG. 1 is a schematic circuit configuration diagram regarding the hardware of an engine control unit of a boat propulsion system according to an embodiment.

The description of various reference numerals and symbols in the drawings may be set forth in accordance with one or more embodiments, for example, as follows: 100: ECU (engine control unit of the boat propulsion system), 10: engine control signal generator, 11: fuel injection controller, 12: air amount adjusting controller, 13: ignition timing controller, 14: predicted boat speed value generator, 15: crankshaft sensor, 16: intake pressure sensor, 21: intake pressure, 26: rotational speed, 30: search through predicted boat speed value map, and 31: predicted boat speed mapped value.

Embodiments of the present invention and their advantages are best understood by referring to the detailed description that follows. It should be appreciated that like reference numerals are used to identify like elements illustrated in one or more of the figures.

DETAILED DESCRIPTION

Figure 2:
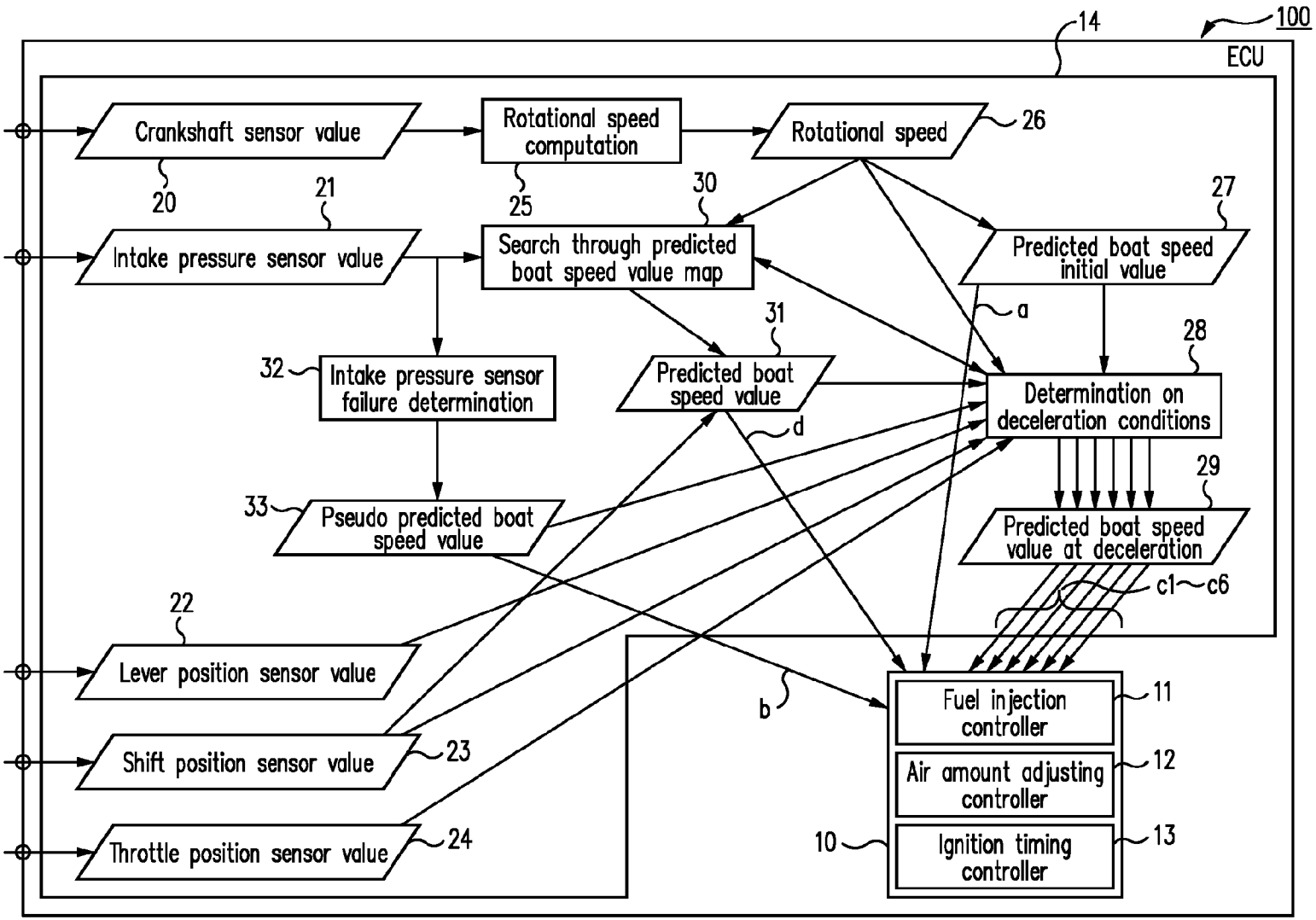
FIG. 2 is a functional block diagram showing the processing and flow of the information data related to a predicted boat speed value generator of the engine control unit shown in FIG. 1 according to an embodiment.

FIGS. 1 through 4 show one or more embodiments (e.g., a first embodiment) in accordance with the present invention. First, an example of the structure will be described in detail. Specifically, FIG. 1 is a schematic circuit configuration diagram regarding the hardware of an engine control unit (hereinafter simply referred to as "ECU") 100 of a boat propulsion system in accordance with an embodiment. FIG. 2 is a functional block diagram showing the processing and flow of the information data related to a predicted boat speed value generator 14 of the ECU 100 in accordance with an embodiment.

The ECU 100 has an engine control signal generator 10 and the predicted boat speed value generator 14. As can be seen in FIGS. 1 and 2, the predicted boat speed value generator 14 receives a sensor value 20 from a crankshaft sensor 15 for picking up a crankshaft rotation signal, a sensor value 21 from an intake pressure sensor 16 for detecting the intake pressure downstream of the throttle valve, a sensor value 22 from a lever position sensor 17 for detecting the position of the lever that activates the propeller into forward rotation, no rotation, or reverse rotation, a sensor value 23 from a shift position sensor 18 for detecting the forward, neutral, and reverse positions of the dog clutch that transfers the rotation of the engine output shaft to the propeller shaft, and a sensor value 24 from a throttle position sensor 19 for detecting the position of the throttle lever that opens and closes the throttle valve. The lever position sensor 17 inputs the sensor value 22 that discriminates between forward, neutral, and reverse.

The predicted boat speed value generator 14 provides (or inputs) plural predicted boat speed values into the engine control signal generator 10 by performing the required computation that will be described further herein. The engine control signal generator 10 is configured so that, as the predicted boat speed values are provided to it, the computations are performed in a fuel injection controller 11, an air amount adjusting controller 12, and an ignition timing controller 13, based on the predicted boat speed values, to provide respectively a fuel injection control signal, an amount of air adjustment control signal, and an ignition timing control signal as outputs (i.e., output signals).

Figure 3A:
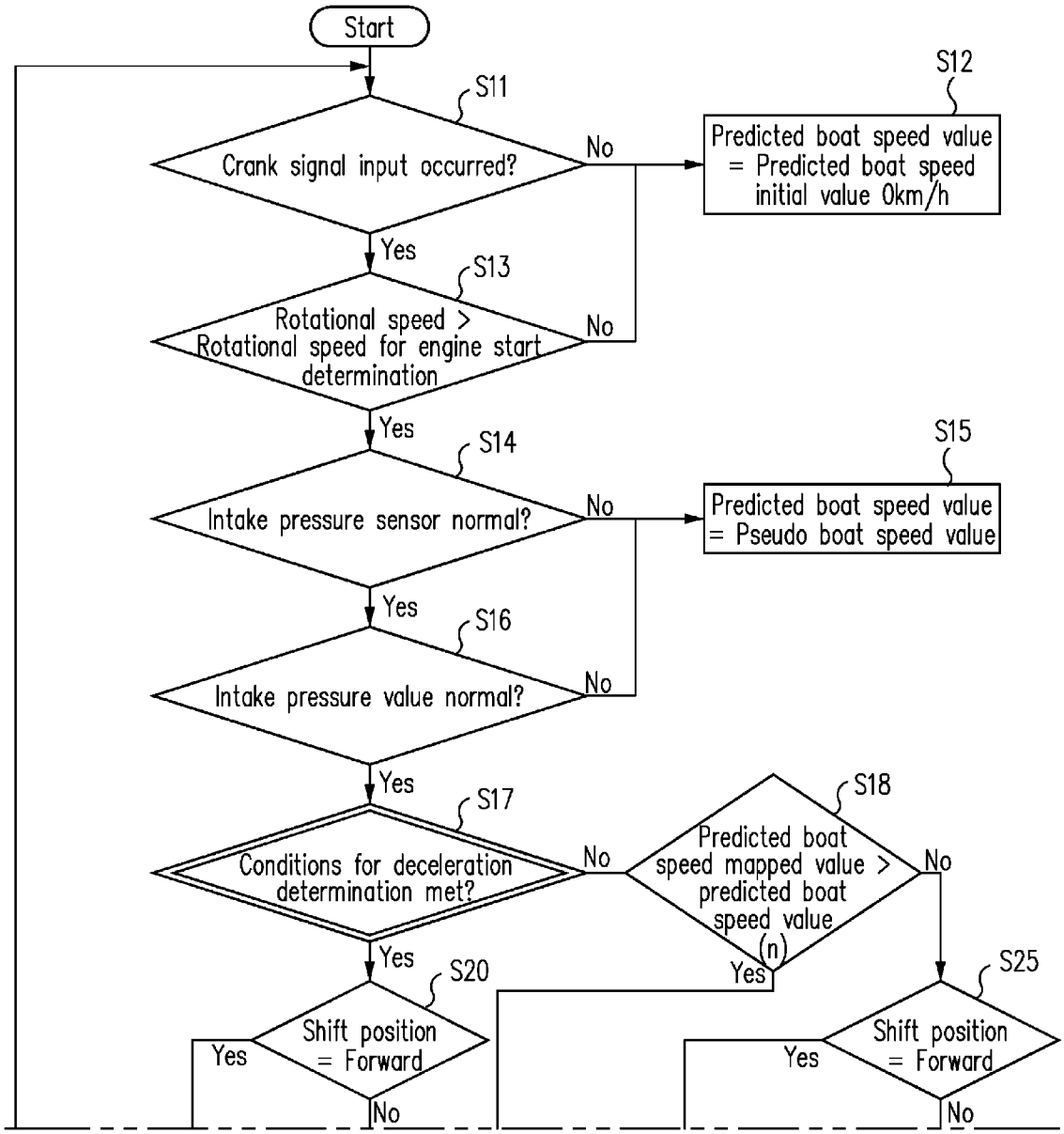
Figure 4A:
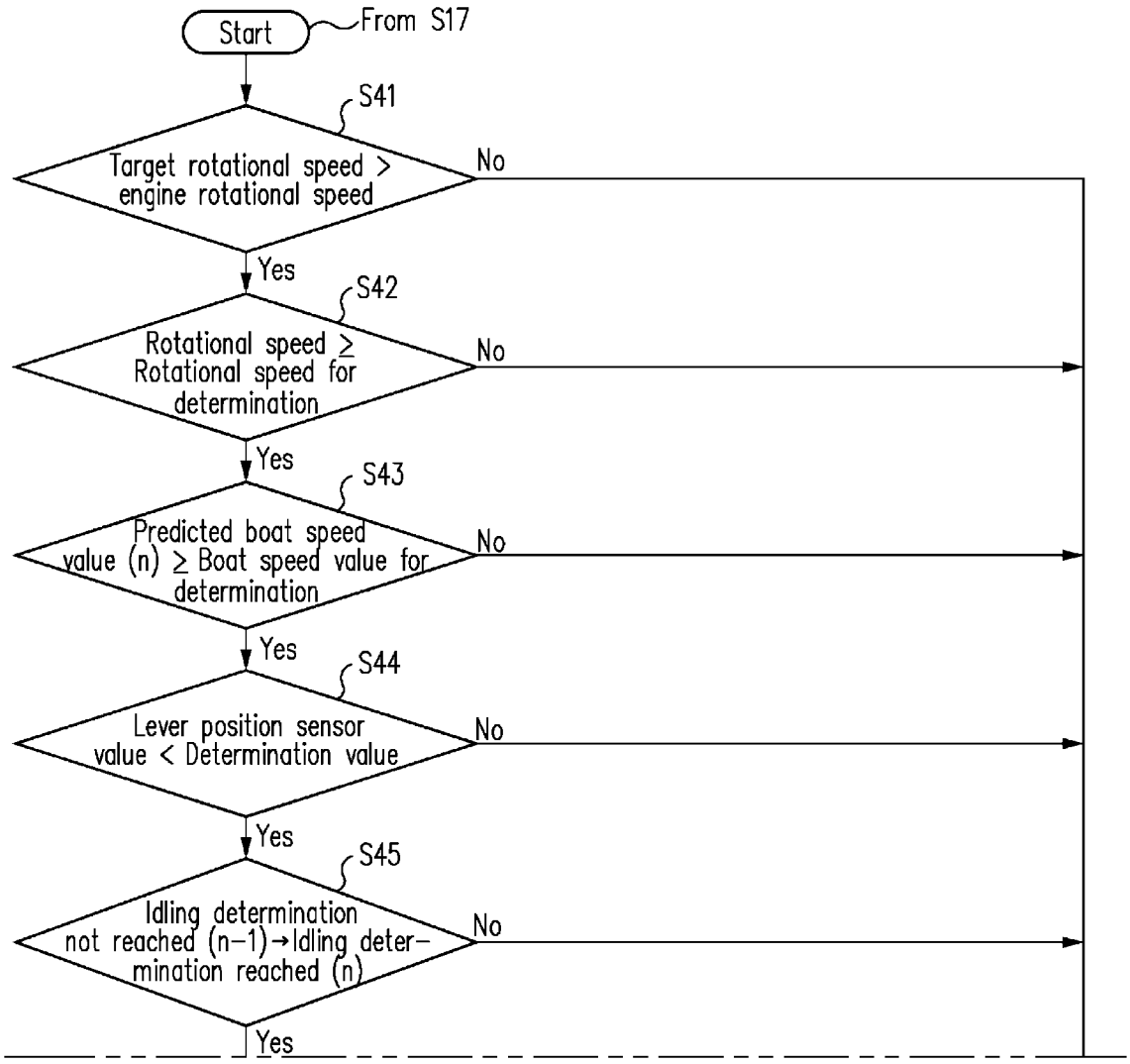

The generating process of the predicted boat speed value will be described herein in accordance with one or more embodiments in reference to FIGS. 2 through 4. FIG. 3 is a flow chart (main routine) showing an example of the control procedure performed by the predicted boat speed value generator 14 (e.g., in single or plural CPU(s)) in accordance with an embodiment. FIG. 4 is a flow chart (sub routine) showing an example of the detailed control procedure related to Step S17 in FIG. 3 in accordance with an embodiment.

First, the engine start is determined by the presence or absence of a crank signal input (Step S11). Here, a rotational speed computation operation 25 is performed based on the crankshaft sensor value 20 (See FIG. 2). Crank signal input does not exist if the engine does not start, and the rotational speed 26 equal to 0 km/h is obtained by the computation, generating 0 km/h as a predicted boat speed initial value 27, which is output to the engine control signal generator 10 (Step S12 in FIG. 3, Arrow "a" in FIG. 2). Thus, no engine control signal is output from the engine control signal generator 10.

Crank signal input occurs if the engine starts, and the determination of "YES" is made in Step S11, and the process goes to Step S13. In Step S13, the rotational speed 26 is computed, and a determination is made as to whether the rotational speed 26 exceeds the rotational speed for engine start determination (threshold=1200 rpm, for instance). If failure of the engine start takes place, the result of the determination is "NO", and in this case again, 0 km/h is generated as a predicted boat speed initial value 27, which is output to the engine control signal generator 10 (Step S12). When the result of the determination is "YES", the process goes to Step S14.

In Step S14, a determination is made as to whether the intake pressure sensor is normal (as would be understood by one skilled in the art) or not. When the result of the determination is "YES", the process goes to Step S16, which determines if the intake pressure sensor value 21 is normal or not. Steps S14 and S16 correspond to an intake pressure sensor failure decision 32 in FIG. 2. When the result of the determination either in Step S14 or in Step S16 is "NO", predicted boat speed value equal to pseudo predicted boat speed value 33 is generated and output to the engine control signal generator 10 (Step S15 in FIG. 3, Arrow "b" in FIG. 2). As a result, the engine control signal generator 10 performs the computation based on the pseudo predicted boat speed value 33 to output the engine control signals (i.e., the fuel injection control signal, the amount of air adjustment control signal, and the ignition timing control signal).

When it is determined that the rotational speed exceeds the rotational speed for engine start decision (threshold) and at the same time the intake pressure sensor is normal, a determination is made as to whether the conditions for a deceleration decision are met (Step S17).

Step S17 will be described with reference to FIG. 4. First, the present engine speed is newly computed to determine if the engine speed exceeds the rotational speed for an engine start decision (threshold) (Step S41). If the engine speed exceeds the threshold, it means the boat speed has reached the constant speed (the boat speed of mapped value control), and the result of the determination in Step S41 is "NO". The conditions for the deceleration decision are not met (Step S52).

When the result of the determination in Step S41 is "YES", a determination is made as to whether the engine speed exceeds the rotational speed for a decision (threshold) (Step S42). The rotational speed for the decision is the lowest limit value for initiating the deceleration control. While the engine is accelerated after starting toward the target rotational speed and the rotational speed for the decision has not been attained yet, the result of the determination in Step S42 is "NO", and the conditions for the deceleration decision are not met (Step S52).

When the result of the determination in Step S42 is "YES", the process goes to Step S43. In Step S43, the present predicted boat speed value (n) is extracted by searching through the predicted boat speed value map (reference numeral 30 in FIG. 2) based on the present engine speed and the intake pressure value, and a determination is made as to whether the predicted boat speed value (n) exceeds the boat speed value for a decision (threshold) which is the lowest limit for initiating the deceleration control. While the engine is accelerated after starting toward the target rotational speed and the boat speed value for the decision has not been attained yet, the result of the determination is "NO", since the predicted boat speed value (n) is smaller, and the conditions for the deceleration decision are not met (Step S52). When the predicted boat speed value (n) is larger, the result of the determination is "YES", and the process goes to Step S44.

In Step S44, the lever position sensor value 22 is input, and a determination is made as to whether the sensor value 22 is smaller than the decision value (threshold). The sensor value 22 exceeds the decision value if the shift lever has passed the forward gear engagement point and has been pushed forward farther to enter into the throttle valve activating range. In such a case, the result of the determination is "NO", and the conditions for the deceleration decision are not met (Step S52). When the sensor value 22 is smaller, the result of the determination is "YES", and the process goes to Step S45.

In Step S45, a determination is made as to whether the idling decision not reached (n−1) status has changed into the idling decision reached (n) status. The result of the determination is "NO" without returning the shift lever to the idling range, and the conditions for the deceleration decision are not met (Step S52). The engine is operated in the idling state when the shift lever is at the position where the forward gear is engaged but the throttle is not open, at the neutral position, or at the position where the reverse gear is engaged but the throttle is not open. In such cases, the result of the determination is "YES" that means the process initiates the deceleration control. At this moment, the process starts counting the deceleration decision validation time. Subsequently, the shift position sensor value 23 is input, and based on the sensor value 23, determination is made if the shift clutch is in the forward position, the neutral position, or the reverse position (Steps S46, S48).

When the shift clutch is in the forward position (Step S46), the counted time elapsed by then is used as the deceleration decision validation time, and a determination is made as to whether the deceleration decision validation time is shorter than the decision time (F) T1 sec (Step S47). The result of the determination is "NO" when the deceleration decision validation time is extended because the shift lever operation takes too long, and the conditions for deceleration decision are not met (Step S52). On the other hand, the result of the determination is "YES" when the deceleration decision validation time is short because the shift lever operation is made quickly, and the conditions for deceleration decision are met (Step S51).

Similarly, when the shift clutch is in the neutral position (Step S48), the counted time elapsed by then is used as the deceleration decision validation time, and a determination is made as to whether the deceleration decision validation time is shorter than the decision time (N) T2 sec (Step S49). The result of the determination is "NO" when the deceleration decision validation time is extended because the shift lever operation takes too long, and the conditions for deceleration decision are not met (Step S52). On the other hand, the result of the determination is "YES" when the deceleration decision validation time is short because the shift lever operation is made quickly, and the conditions for the deceleration decision are met (Step S51).

Similarly again, when the shift clutch is in the reverse position (Step S50), the counted time elapsed by then is used as the deceleration decision validation time, and the determination is made as to whether the deceleration decision validation time is shorter than the decision time (R) T3 sec. The result of the determination is "NO" when the deceleration decision validation time is extended because the shift lever operation takes too long, and the conditions for deceleration decision are not met (Step S52). On the other hand, the result of the determination is "YES" when the deceleration decision validation time is short because the shift lever operation is made quickly, and the conditions for the deceleration decision are met (Step S51).

Decision time is a predetermined value chosen in view of avoiding engine stall and stabilizing the rotation. Engine stall may be avoided and rotation may be stabilized by employing the longer decision time corresponding to the increase in the engine load.

Also, the deceleration rate of the boat varies depending on the boat structure, propeller structure, and the variation of the torque delivered by the engine in relation to the shift position.

The attenuation decision validation time changes according to the deceleration rate of the boat as would be understood by one skilled in the art.

In the forward shift position, the attenuation decision validation time is established based on the engine torque driving the propeller clockwise, and the counterclockwise reaction force exerted by the water flow. In the reverse shift position, the engine torque driving the propeller counterclockwise is effected, however, the clockwise reaction force exerted from the water flow tends to be larger than the reaction force in the case of the forward shift position due to the difference in the way the propeller grips the water and in the boat structure. Therefore, the attenuation decision validation time is set to be shorter than that applied to the forward shift position. In the neutral shift position, the boat speed drops most quickly because there is no engine torque driving the propeller, and the counterclockwise torque is exerted by the water flow, which works to stop the propeller rotation. Therefore, the attenuation decision validation time is set to be shorter than that applied to the reverse shift position.

In summary, the attenuation decision validation times are set to be (F)T1sec.>(R)T3sec.>(N)T2sec. Now, the description related to FIG. 4 is completed, and referring back to Step S17 of the flowchart in FIG. 3, the subsequent process will be described.

If the conditions for the deceleration decision are not met in Step S17, the process goes to Step S18. Computation for Step S18 is performed by a separate sub routine (not shown). In step S18, a comparison is made between the predicted boat speed mapped value and the previous predicted boat speed value. If the predicted boat speed mapped value is larger, the process works to make the predicted boat speed value return to the mapped value as would be understood by one skilled in the art.

When the engine speed is maintained higher than the target rotational speed, the process circulates from Step S19 to Step S11 to Step S17, then to Step S18, and back to Step S19, performing the engine control based on the mapped value. In this way, the predicted boat speed is kept close to the actual boat speed while the boat is under way.

When the state in which the engine control is performed based on the mapped value as described above is changed to another state in which the shift lever is kept at idle, the conditions for deceleration decision are met in Step S17. Then, the shift position sensor value 23 is input, and based on the sensor value 23, a determination is made as to whether the shift clutch is in the forward position, in the neutral position, or in the reverse position (Steps S20, S22).

When the shift clutch is in the forward position, the result of the determination in Step S20 is "YES". Then, a predicted boat speed value (n) referred to as "c1" is generated by multiplying the predicted boat speed value in the last cycle (n−1) by the attenuation coefficient K1F of the forward position (under the condition of 0<K1F<1), and the generated value is output to the engine control signal generator 10 (Step S21 in FIG. 3, Arrow "c1" in FIG. 2).

If the deceleration decision has not been made yet, the value of the predicted boat speed value (n−1) is assumed to be equal to the predicted boat speed mapped value (rotational speed minus intake pressure). When the shift clutch is maintained in the forward position, the process circulates from Step S21 to Step S11, then to Step S17 to Step S20, and back to Step S21, with the attenuating coefficient K1F, for example, being computed by powers (e.g., by CPU using equations in the figure). Thus the engine is controlled to decelerate gradually, and the predicted boat speed is kept close to the actual boat speed in the course of deceleration.

When the shift clutch is not in the forward position in Step S20, the result of the determination is "NO", and the process goes to Step S22. When the shift clutch is in the neutral position, the result of the determination is "YES" and the process goes to Step S23. Then, a predicted boat speed value (n) referred to as "c2" is generated by multiplying the predicted boat speed value in the last cycle (n−1) by the attenuation coefficient K1F of the neutral position (under the condition of 0<KIN<1, K1N<K1F), and the generated value is output to the engine control signal generator 10 (Step S23 in FIG. 3, Arrow "c2" in FIG. 2). Here, the initial value of the predicted boat speed value in the last cycle (n−1) is the mapped value at the time the deceleration control is initiated. When the shift clutch is maintained in the neutral position, the process circulates from Step S23 to Step S11, then to Step S17, followed by Step S20, and then Step S22, and back to Step S23, with the attenuating coefficient K1N, for example, being computed by powers (e.g., by CPU using equations in the figure). Thus, the engine is controlled to decelerate with a smaller attenuation factor than that in the forward position, and the predicted boat speed is kept close to the actual boat speed in the course of deceleration.

When the shift clutch is in the reverse position in Step S22, the result of the determination is "NO". Then, a predicted boat speed value (n) referred to as "c3" is generated by multiplying the predicted boat speed value in the last cycle (n−1) by the attenuation coefficient K1R of the reverse position (under the condition of 0<K1R<1, K1R<K1N), and the generated value is output to the engine control signal generator 10 (Step S24 in FIG. 3, Arrow "c3" in FIG. 2). Here, the initial value of the predicted boat speed value in the last cycle (n−1) is the mapped value at the time the deceleration control is initiated. When the shift clutch is maintained in the reverse position, the process circulates from Step S24 to Step S11, then to Step S17, followed by Step S20, and then Step S22, and back to Step S24, with the attenuating coefficient K1R, for example, being computed by powers (e.g., by CPU using equations in the figure). Thus, the engine is controlled to decelerate with a smaller attenuation factor than that in the neutral position, and the predicted boat speed is kept close to the actual boat speed in the course of deceleration.

When the shift lever is operated for deceleration followed by acceleration, and immediate deceleration to pull up the boat alongside the quay, acceleration attenuating coefficient K1F becomes larger than the deceleration attenuating coefficient K1R, resulting in the disagreement between the predicted boat speed value of c1 and the predicted boat speed value of c3. Thus, a brief, transient acceleration may be performed effectively, and the shift lever can be operated efficiently to pull up the boat easily alongside the quay.

Furthermore, when the state in which the engine deceleration control is performed as described above is changed to another state in which the shift lever is in the forward position and kept at open throttle, the result of the determination in Step S17 regarding the fulfillment of conditions for deceleration decision is "NO", because the lever position sensor value is larger than the decision value in Step S44 in FIG. 4. Thus, the conditions for deceleration decision are not met, and the process goes to Step S18. At the time the process goes to Step S18, the result of the determination in Step S18 is "NO" because the engine speed has not reached the target speed. Then, the shift position sensor value 23 is input, and based on the sensor value 23, the determination is made as to whether the shift clutch is in the forward position, in the neutral position, or in the reverse position (Steps S25, S27).

When the shift clutch is in the forward position, the result of the determination in Step S25 is "YES". Then, a predicted boat speed value (n) referred to as "c4" is generated by adding the value obtained by multiplying the predicted boat speed value in the last cycle (n−1) by the incremental coefficient K2F of the forward position (under the condition of 0<K2F<1), to the value obtained by multiplying the mapped value by (1+K2F), and the generated value is output to the engine control signal generator 10 (Step S26 in FIG. 3, Arrow "c4" in FIG. 2). Here, the initial value of the predicted boat speed value in the last cycle (n−1) is the mapped value at the time the deceleration control is terminated, and is added to the value obtained by multiplying the mapped value by (1+K2F) for weighting. When the shift clutch is maintained in the forward position, the process circulates from Step S26 to Step S11, then to Step S17, followed by Step S18, and then Step S25, and back to Step S26, with the weighting value and the incremental coefficient K2F, for example, being computed by powers (e.g., by CPU using equations in the figure). Thus, the engine is controlled to accelerate gradually, and the predicted boat speed is kept close to the actual boat speed in the course of acceleration.

When the shift clutch is not in the forward position in Step S25, the result of the determination is "NO", and the process goes to the determination in Step S27. When the shift clutch is in the neutral position, the result of the determination is "YES" and the process goes to Step S28. Then, a predicted boat speed value (n) referred to as "c5" is generated by adding the value obtained by multiplying the predicted boat speed value in the last cycle (n−1) by the incremental coefficient K2N of the neutral position (under the condition of 0<K2N<1, K2N<K2F), to the value obtained by multiplying the mapped value by (1+K2N), and the generated value is output to the engine control signal generator 10 (Step S28 in FIG. 3, Arrow "c5" in FIG. 2). Here, the initial value of the predicted boat speed value in the last cycle (n−1) is the mapped value at the time the deceleration control is terminated, and is added to the value obtained by multiplying the mapped value by (1+K2N) for weighting. When the shift clutch is maintained in the neutral position, the process circulates from Step S28 to Step S11, then to Step S17, followed by Step S18, and then Step S25 and S27, and back to Step S28, with the weighting value and the attenuation coefficient K2N, for example, being computed by powers (e.g., by CPU using equations in the figure). Thus, the engine is accelerated gradually with smaller increments than that in the forward position, but the propeller does not rotate. This is utilized in the engine control when the boat is leaving the quay.

When the shift clutch is in the reverse position, the result of the determination in Step S27 is "NO". Then, a predicted boat speed value (n) referred to as "c6" is generated by adding the value obtained by multiplying the predicted boat speed value in the last cycle (n−1) by the incremental coefficient K2R of the reverse position (under the condition of 0<K2R<1, K2N<K2R), to the value obtained by multiplying the mapped value by (1+K2R), and the generated value is output to the engine control signal generator 10 (Step S29 in FIG. 3, Arrow "c6" in FIG. 2). Here, the initial value of the predicted boat speed value in the last cycle (n−1) in this recovery control is the predicted boat speed value at the time the deceleration control is terminated, and is added to the value obtained by multiplying the mapped value by (1+K2R) for weighting. When the shift clutch is maintained in the reverse position, the process circulates from Step S29 to Step S11, then to Step S17, followed by Step S18, Step 25, and then Step S27, and back to Step S29, with the weighting value and the attenuation coefficient K2R, for example, being computed by powers (e.g., by CPU using equations in the figure). Thus, the engine is accelerated (in reverse) gradually with smaller increments than that in the forward position. This is utilized in the engine control when the boat is leaving the quay.

As have been described in the preceding sections, the predicted boat speed value generator 14 has; a predicted boat speed mapped value extracting means configured to perform the search through the predicted boat speed value map during the constant speed operation and the acceleration, based on the rotational speed 26 and the intake pressure 21 measured in the downstream side of the throttle valve regarding the engine of the boat propulsion system, and to extract the predicted boat speed mapped value 31 for output, a predicted decelerating boat speed value output means configured to input the last predicted boat speed mapped value 31 at the time of deceleration, to establish the initial predicted boat speed value by multiplying the attenuation coefficient (K1F, K1N, K1R) by the predicted boat speed mapped value 31, with the attenuation coefficient being predetermined according to the shift positions of forward, neutral, and reverse to be descending in this order, to perform the similar computation in each of the following cycles applying the last predicted boat speed mapped value, and to output the attenuating predicted boat speed value in every cycle, and a predicted recovering boat speed value output means configured to perform the search through the predicted boat speed value map when the boat speed transitions from the deceleration to the constant speed or to the acceleration, based on the rotational speed 26 and the intake pressure 21 in the downstream side of the throttle valve regarding the engine of the boat propulsion system at the start of such speed transition, and extract the predicted boat speed mapped value 31, to input the predicted boat speed value obtained at the end of deceleration, to establish the initial predicted boat speed value by multiplying the incremental coefficient (K2F, K2N, K2R) by the predicted boat speed mapped value obtained at the end of the deceleration, with the incremental coefficient being predetermined according to the shift positions of forward, neutral, and reverse to be descending in this order, to perform the similar computation in each of the following cycles by applying the last predicted boat speed mapped value and the predicted boat speed mapped value, and to output the gradually increasing predicted boat speed value in every cycle.

According to this embodiment, the predicted boat speed value may be maintained in an approximately equal level to the actual boat speed value in various operating patterns of outboard motors, which allows for the appropriate control on the amount of injected fuel and the amount of air, smooth deceleration in any operating environment, and stabilized engine speed after the deceleration. Especially during the deceleration, for example, the predicted boat speed values are appropriately different among the forward, neutral, and reverse shift positions, resulting in the appropriately different attenuation rates of the predicted boat speed value. Thus, even when the shift lever is operated in such a pattern that the deceleration is followed by a brief, transient acceleration (that is, an acceleration for a minimal period of time) and an immediate deceleration when pulling up the boat alongside the quay, the predicted boat speed generally equal to the actual boat speed can be obtained, allowing the generation of driving torque compatible with the boat speed and the smooth maneuvering with the stable engine rotation. Thus, the deceleration can be made without engine hunting or engine stall, and the swift maneuvering for pulling up the boat alongside the quay can be achieved. Also in the course of deceleration, the predicted boat speed can be kept close to the actual boat speed regardless of the shift position in the forward, neutral, or reverse. Thus, improved maneuverability may be obtained.

Additionally, when the boat speed transitions from the deceleration to the constant speed or to the acceleration in the present embodiment, the predicted boat speed values are appropriately different among the forward, neutral, and reverse shift positions, which results in appropriately different increment rates of the predicted boat speed value. Thus, the predicted boat speed obtained by computation can be kept close to the actual boat speed regardless of the shift position in the forward, neutral, or reverse. Also, the predicted boat speed value increases gradually in every cycle to allow the appropriate increment of fuel injection amount and the amount of air, and the engine speed increases evenly until the given constant speed is attained. Consequently, engine hunting and engine stall may be avoided in this way.

Furthermore, in the case of deceleration, the time frame for attenuating the predicted boat speed can be set separately for different shift positions among which the operating load of the engine varies. Therefore for example, the boat propulsion force varies among the forward, reverse, and neutral shift positions, and the torque for driving the propeller is not the same in each shift position. The ideal fuel injection amount and the ideal amount of air for each shift position are delivered for generating the driving torque compatible with the shift position. Thus, the engine rotation is stabilized and the smooth operation is attained.

The increment value may be reflected in every cycle, for example, and the value per cycle may be determined by the shift position. Therefore, the boat propulsion force varies among the forward, reverse, and neutral shift positions, and the torque for driving the propeller is not the same in each shift position. In trying to keep the predicted boat speed close to the actual boat speed when the boat speed transitions from the deceleration to the acceleration, for example, it may be impossible to switch immediately to the predicted boat speed value based on the rotational speed and the intake value, because the engine has to go through the steps starting from the deceleration, switch to the constant speed, and then switch to the acceleration. During the transition from the deceleration to the acceleration, a gradual increment may be employed, and the boat speed is predicted taking into account the operating load variation depending on the shift position. In this way, the optimal fuel injection amount and the amount of air is established to allow the smooth maneuvering and the stable engine rotation.

Still further, in this embodiment for example, the computation of the predicted boat speed value that is being attenuated in every cycle during the deceleration, as well as the computation of the predicted boat speed value that is incremented in every cycle during the speed recovery can be made smoothly while making a determination of the transition from the constant speed or acceleration to the deceleration, or the transition from the deceleration to the constant speed or acceleration. Additionally, the recovery to the constant speed or the acceleration that employs the predicted boat speed mapped value may be achieved by way of the computation of predicted boat speed at the recovery. Thus, the predicted boat speed value can be closer to and at approximately the same level as the actual boat speed, which allows for the appropriate control on the amount of injected fuel and the amount of air in response to the various engine operating patterns, smooth deceleration in any operating environment, and stabilized engine speed after the deceleration.

Also for example, by obtaining the predicted boat speed generally equivalent to the actual boat speed in any operating environment, optimized control on the amount of air and the fuel injection may be achieved based on the boat speed, so that the boat propulsion force compatible with the maneuvering environment (e.g., operating conditions, engine load conditions, environmental conditions, and so on) may be obtained. Thus, easy maneuvering may be assured in this way.

The present invention is not limited to the aforementioned embodiments, but may be altered for implementation in various ways within the scope of its intention and engineering ideas and principles. In accordance with one or more embodiments, for example, an engine control unit of a boat propulsion system and a boat (incorporating the engine control unit) may be provided in which the attenuation rate of the engine speed after the deceleration may be improved to obtain the predicted boat speed generally equal to the actual boat speed. Furthermore in accordance with some embodiments, the appropriate control on the amount of injected fuel and the amount of air may be achieved to deal with the various engine operating patterns.

In accordance with one or more embodiments, a predicted boat speed value generator 14 is disclosed for inputting an engine rotation detecting signal 20, an intake pressure value 21 and other detection signals, including shift position, and outputting a predicted boat speed value. A control signal generator 10 determines the fuel injection amount, the amount of air, and the ignition timing based on the predicted boat speed to output the respective control signals. The predicted boat speed value generator 14 includes a predicted boat speed mapped value extracting means is disclosed to perform the search through the predicted boat speed value map during the constant speed operation and the acceleration, based on the rotational speed 26 and the intake pressure 21, and to extract the predicted boat speed mapped value "d" for output. A predicted decelerating boat speed value output means is disclosed for inputting the last predicted boat speed mapped value "d" at the time of deceleration, to establish the initial predicted boat speed value by multiplying the input value "d" by the attenuation coefficients that varies according to the shift positions, and to perform the similar computation in each of the following cycles, outputting the attenuating predicted boat speed value in every cycle.

Embodiments described above illustrate but do not limit the invention. It should also be understood that numerous modifications and variations are possible in accordance with the principles of the present invention. Accordingly, the scope of the invention is defined only by the following claims.

What is claimed is:

1. An engine control unit for a boat propulsion system comprising:

a predicted boat speed value generator adapted to provide predicted boat speed values by receiving and processing signals related to an engine speed, an intake pressure taken at a downstream side of a throttle valve, a lever position, a shift position, and a throttle position;

a control signal generator adapted to receive the predicted boat speed values from the predicted boat speed value generator to determine an injection amount, an amount of air, and an ignition timing based on the predicted boat speed values to provide a fuel injection control signal, an air adjustment control signal, and an ignition timing control signal, respectively;

wherein the predicted boat speed value generator is adapted to perform a predicted boat speed mapped value extraction process to search through a predicted boat speed value map during a constant speed operation and an acceleration, based on the engine speed and the intake pressure, to extract and provide a predicted boat speed mapped value; and wherein the predicted boat speed value generator is further adapted to perform a predicted decelerating boat speed value output process to initially receive the last predicted boat speed mapped value at a time of deceleration, establish an initial predicted boat speed value by multiplying attenuation coefficients that vary according to the shift positions by the predicted boat speed mapped value obtained at an end of the deceleration, perform a similar computation in each following cycle using the last predicted boat speed mapped value, and provide an attenuated predicted boat speed value in every cycle.

2. The engine control unit for the boat propulsion system according to claim 1, wherein the predicted decelerating boat speed value output process is adapted to set different attenuation validation times for each shift position of forward, neutral, and reverse.

3. The engine control unit for the boat propulsion system according to claim 2, wherein the predicted boat speed value generator is further adapted to perform a predicted recovering boat speed value output process, to search through the predicted boat speed value map when a boat speed transitions from a deceleration to a constant speed or to an acceleration, based on the intake pressure and the engine speed at a beginning of the boat speed transition, to extract the predicted boat speed mapped value, and at approximately the same time, receive the predicted boat speed value obtained at the end of deceleration, to establish the initial predicted boat speed value by multiplying the incremental coefficient that varies according to the shift positions by the predicted boat speed mapped value obtained at the end of the deceleration, perform a similar computation in each following cycle by applying the last predicted boat speed mapped value and the predicted boat speed mapped value, and provide the predicted boat speed value, which is gradually increasing, in every cycle.

4. The engine control unit for the boat propulsion system according to claim 3, wherein the predicted boat speed value generator is further adapted to perform a process to determine if a boat speed has transitioned to a deceleration state, or has transitioned from a boat speed recovery state to a constant speed or an acceleration state, and, based on the predicted recovering boat speed value output process, recover control based on the predicted boat speed mapped value extraction process.

5. The engine control unit for the boat propulsion system according to claim 1, wherein the predicted boat speed value generator is further adapted to perform a predicted recovering boat speed value output process, to search through the predicted boat speed value map when a boat speed transitions from a deceleration to a constant speed or to an acceleration, based on the intake pressure and the engine speed at a beginning of a speed transition, to extract the predicted boat speed mapped value, and at approximately the same time, receive the predicted boat speed value obtained at the end of deceleration, to establish the initial predicted boat speed value by multiplying the incremental coefficient that varies according to the shift positions by the predicted boat speed mapped value obtained at the end of the deceleration, perform a similar computation in each following cycle by applying the last predicted boat speed mapped value and the predicted boat speed mapped value, and provide the predicted boat speed value, which is gradually increasing, in every cycle.

6. The engine control unit for the boat propulsion system according to claim 5, wherein the predicted boat speed value generator is further adapted to perform a process to determine if a boat speed has transitioned to a deceleration state, or has transitioned from a boat speed recovery state to a constant speed or an acceleration state, and, based on the predicted recovering boat speed value output process, recover control based on the predicted boat speed mapped value extraction process.

7. A boat, comprising the engine control unit for the boat propulsion system according to claim 1.

8. A boat, comprising the engine control unit for the boat propulsion system according to claim 2.

9. A boat, comprising the engine control unit for the boat propulsion system according to claim 3.

10. A boat, comprising the engine control unit for the boat propulsion system according to claim 4.

11. A boat, comprising the engine control unit for the boat propulsion system according to claim 5.

12. A boat, comprising the engine control unit for the boat propulsion system according to claim 6.

13. A method for controlling a boat propulsion system, the method comprising:

receiving signals related to an engine speed, an intake pressure, a lever position, a shift position, and a throttle position;

processing the signals to provide predicted boat speed values;

determining an injection amount, an amount of air, and an ignition timing based on the predicted boat speed values;

providing a fuel injection control signal, an air adjustment control signal, and an ignition timing control signal based on the determining;

searching through a predicted boat speed value map during a constant speed operation and an acceleration, based on the signals related to the engine speed and the intake pressure;

providing a predicted boat speed mapped value based on the searching; and determining an initial predicted boat speed value by multiplying attenuation coefficients that vary according to the shift positions by the predicted boat speed mapped value obtained at an end of a deceleration.

14. The method of claim 13, further comprising repeating the determining of the initial predicted boat speed value using the last predicted boat speed mapped value to provide an attenuated predicted boat speed value in every cycle.

15. The method of claim 14, further comprising setting different attenuation validation times based on the shift positions of forward, neutral, and reverse to be used by the determining of the initial predicted boat speed value.

16. The method of claim 15, further comprising:

searching through the predicted boat speed value map when a boat speed transitions from a deceleration to a constant speed or to an acceleration, based on the signals related to the intake pressure and the engine speed at a beginning of the boat speed transition to provide the predicted boat speed mapped value;

receiving the predicted boat speed value obtained at the end of the deceleration;

establishing the initial predicted boat speed value by multiplying an incremental coefficient that varies according to the shift positions by the predicted boat speed mapped value obtained at the end of the deceleration; and performing the establishing in each following cycle by applying the last predicted boat speed mapped value and the predicted boat speed mapped value to provide the predicted boat speed value, which is gradually increasing, in every cycle.

17. The method of claim 16, further comprising:

determining if a boat speed has transitioned to a deceleration state or has transitioned from a boat speed recovery state to a constant speed or an acceleration state; and recovering control based on the searching and the providing of the predicted boat speed mapped value and based on the performing of the establishing.

* * * * *